US005970995A

United States Patent [19]

Schy

[11] Patent Number: 5,970,995

[45] Date of Patent: Oct. 26, 1999

[54] KIT FOR REMOVING CALCIUM DEPOSITS IN A SHOWER HEAD WITHOUT REMOVING THE SHOWER HEAD FROM A SHOWER ARM

[76] Inventor: William W. Schy, 1110 Central Ave., Riverside, Calif. 92507

[21] Appl. No.: 09/224,926

[22] Filed: Dec. 31, 1998

[51] Int. Cl.[6] ..... B08B 3/00

[52] U.S. Cl. ..... 134/170; 134/201; 134/166 R

[58] Field of Search ..... 134/59, 93, 166 R, 134/167 C, 170, 201, 84, 85, 92, 104.1, 166 C; 239/104, 106

[56] References Cited

U.S. PATENT DOCUMENTS

| | | | |
|---|---|---|---|
| 2,022,882 | 12/1935 | Erdmann . | |
| 2,569,125 | 9/1951 | Constantino . | |
| 2,578,572 | 12/1951 | Melvin et al. . | |
| 3,701,341 | 10/1972 | Willis, Jr. | 122/392 |
| 3,876,144 | 4/1975 | Madden et al. | 239/106 |
| 4,081,875 | 4/1978 | Nishino | 15/104.6 R |
| 4,881,561 | 11/1989 | Schwarzwalder | 134/76 |
| 4,923,522 | 5/1990 | Sowers | 134/22.1 |
| 4,960,142 | 10/1990 | Robb et al. | 134/138 |
| 5,094,742 | 3/1992 | Shalhoob | 210/222 |
| 5,183,066 | 2/1993 | Hethcoat | 134/54 |
| 5,433,230 | 7/1995 | Miller | 134/110 |
| 5,468,303 | 11/1995 | Thomas, Sr. | 134/3 |
| 5,480,574 | 1/1996 | Singerman | 252/82 |
| 5,727,580 | 3/1998 | Patterson | 134/115 R |
| 5,788,778 | 8/1998 | Shang et al. | 134/1 |
| 5,840,251 | 11/1998 | Iwaki | 422/36 |
| 5,851,308 | 12/1998 | Engelking et al. | 134/22.17 |

FOREIGN PATENT DOCUMENTS

| | | | |
|---|---|---|---|
| 004038719 | 7/1991 | Germany | 134/166 R |
| 404215880 | 8/1992 | Japan | 134/93 |
| 406206054 | 7/1994 | Japan | 134/166 R |

*Primary Examiner*—Frankie L. Stinson
*Assistant Examiner*—Paul J. Lee
*Attorney, Agent, or Firm*—Richard L Miller, P.E.

[57] ABSTRACT

A kit for removing calcium deposits in a shower head extending from a shower arm without removing the shower head from the shower arm. The kit includes a first portion and a second portion. The first portion is replaceably attached to the shower arm, adjacent the shower head. The second portion is replaceably suspended from the first portion and receives the shower head and is filled with a mild acid, with the shower head submerged therein, so as to allow the mild acid to dissolve the calcium deposits in the shower head soaking in the mild acid in the second portion, without having to remove the shower head from the shower arm.

8 Claims, 1 Drawing Sheet

KIT FOR REMOVING CALCIUM DEPOSITS IN A SHOWER HEAD WITHOUT REMOVING THE SHOWER HEAD FROM A SHOWER ARM

BACKGROUND OF THE INVENTION

1. Field of the Invention

The present invention relates to a kit for removing calcium deposits in a shower head. More particularly, the present invention relates to a kit for removing calcium deposits in a shower head extending from a shower arm without removing the shower head from the shower arm.

2. Description of the Prior Art

Rooms in better quality hotels are clean, nicely decorated, have good beds, fine television, convenient ice, but terrible showers.

Virtually everyone knows that one can take the shower head down, place it in container of vinegar overnight, and the shower head will work like new the next day.

Commercial uses, such as hotels, are reluctant to remove shower heads even if they keep spares. Residential users often are people without tools or mechanical ability to remove the shower heads without damaging something else.

Numerous innovations for nozzle related cleaning device have been provided in the prior art that will be described. Even though these innovations may be suitable for the specific individual purposes to which they address, however, they differ from the present invention.

A FIRST EXAMPLE, U.S. Pat. No. 3,876,144 to Madden et al. teaches apparatus for preventing build-up of sealing compound at the outlet of an intermittently operated sealing compound ejecting nozzle. In the device, a stream of air is directed towards the outlet of the nozzle from a suitable air outlet, and a solvent is injected into the air stream at a point upstream from the air outlet, the air outlet being located at a distance from the nozzle such that turbulence of the air stream occurs in the area of the nozzle. The rate of supply of solvent to the air stream is such as to produce an atmosphere saturated with solvent in the turbulent area. This prevents evaporation of solvent from the sealing compound and hence prevents the sealing compound building up at the outlet of the nozzle.

A SECOND EXAMPLE, U.S. Pat. No. 4,081,875 to Nishino teaches a scale removal device for scraping off scale deposited on the inner surface of a tube section comprising a rotary shaft to be received within said tube section for advancement and rotation under the action of fluid under pressure pumped into the tube section and having a spiral blade thereabout, a scraper head detachably connected to the leading end of said rotary shaft and having resilient scraper blades thereabout for yieldingly abutting against the inner surface of said tube section and connector means detachably connecting said rotary shaft and scraper head.

A THIRD EXAMPLE, U.S. Pat. No. 5,183,066 to Hethcoat teaches apparatus for cleaning paint spray gun nozzles automatically that includes a housing having separate cleaning and reservoir chambers separated by a dividing wall, and a cleaning spray head in the cleaning chamber for directing a spray of cleaning fluid at a nozzle in the chamber. A supply of cleaning fluid in the reservoir is connected to the cleaning spray head by a supply tube. The cleaning chamber has an entrance for receiving a spray gun nozzle, and a supply of gas under pressure is connected to the reservoir chamber automatically on detection of entry of a spray gun nozzle through the entrance, to urge cleaning fluid from the reservoir into the supply tube. A passageway is provided in the dividing wall for returning used cleaning fluid to the reservoir. The supply of gas to the reservoir is cut off automatically at the end of a cleaning cycle on removal of the cleaned nozzle from the chamber.

A FOURTH EXAMPLE, U.S. Pat. No. 5,468,303 to Thomas, Sr. teaches a rust, corrosion, and scale removing composition. It comprises an additive concentrate and water. The additive concentrate preferably consists of, on a parts by weight basis, 1.5 to 5 parts glycolic acid, 0.2 to 1 parts tetrasodium salt of ethylenediaminetetraacetic acid, 2 to 6 parts citric acid, and 1 to 3 parts trisodium citrate dihydrate.

It is apparent that numerous innovations for nozzle cleaning related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a kit for removing calcium deposits in a shower head extending from a shower arm without removing the shower head from the shower arm that avoids the disadvantages of the prior art.

ANOTHER OBJECT of the present invention is to provide a kit for removing calcium deposits in a shower head extending from a shower arm without removing the shower head from the shower arm that is simple and inexpensive to manufacture.

STILL ANOTHER OBJECT of the present invention is to provide a kit for removing calcium deposits in a shower head extending from a shower arm without removing the shower head from the shower arm that is simple to use.

BRIEFLY STATED, YET ANOTHER OBJECT of the present invention is to provide a kit for removing calcium deposits in a shower head extending from a shower arm without removing the shower head from the shower arm. The kit includes a first portion and a second portion. The first portion is replaceably attached to the shower arm, adjacent the shower head. The second portion is replaceably suspended from the first portion and receives the shower head and is filled with a mild acid, with the shower head submerged therein, so as to allow the mild acid to dissolve the calcium deposits in the shower head soaking in the mild acid in the second portion, without having to remove the shower head from the shower arm.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

Figure 1:
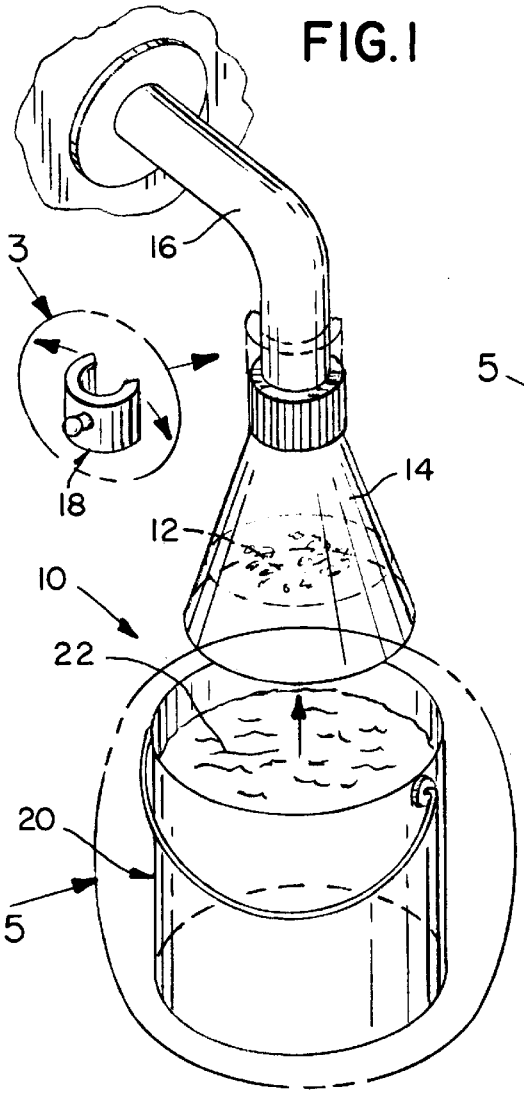
FIG. 1 is a diagrammatic perspective view of the present invention being installed on a shower arm.

LIST OF REFERENCE NUMERALS UTILIZED IN THE DRAWING kit for removing calcium deposits in a shower head extending from a shower arm without removing the shower head from the shower arm of the present invention
calcium deposits
shower head
shower arm
first portion for replaceably attaching to shower arm 16, adjacent shower head 14
second portion for receiving shower head 14 and for filling with mild acid 22
mild acid
collar of first portion 18 for replaceably snapping around shower arm 16, adjacent shower head 14, without having to remove shower head 14 from shower arm 16
hook of first portion 18
cup of second portion 20 for receiving shower head 14 and for filling with mild acid 22
bale handle of second portion 20

DESCRIPTION OF THE PREFERRED EMBODIMENT

Figure 2:
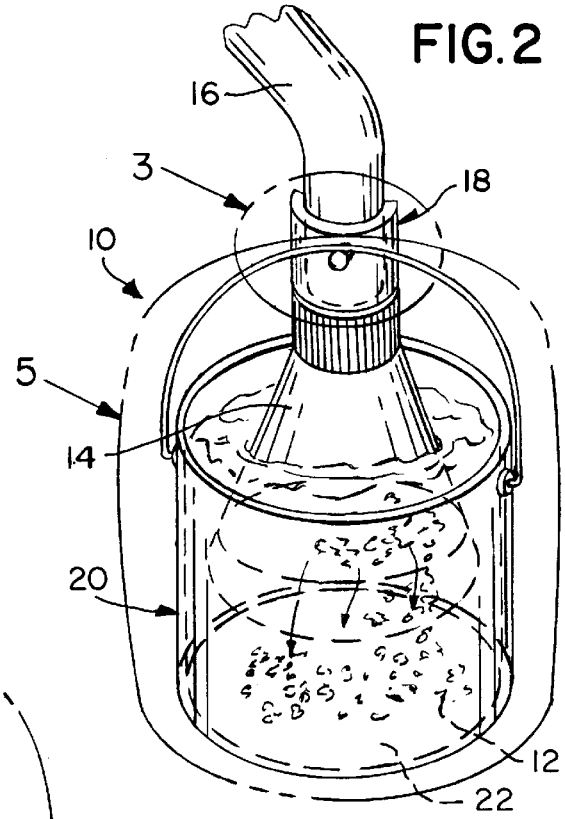
FIG. 2 is a diagrammatic perspective view of the present invention in use.

Referring now to the figures, in which like numerals indicate like parts, and particularly to FIGS. 1 and 2, the kit for removing calcium deposits in a shower head extending from a shower arm without removing the shower head from the shower arm of the present invention is shown generally at 10 for removing calcium deposits 12 in a shower head 14 extending from a shower arm 16 without removing the shower head 14 from the shower arm 16.

The general configuration of the kit for removing calcium deposits in a shower head extending from a shower arm without removing the shower head from the shower arm 10 can best be seen in FIGS. 1 and 2, and as such, will be discussed with reference thereto.

The kit for removing calcium deposits in a shower head extending from a shower arm without removing the shower head from the shower arm 10 comprises a first portion 18 for replaceably attaching to the shower arm 16, adjacent the shower head 14.

The kit for removing calcium deposits in a shower head extending from a shower arm without removing the shower head from the shower arm 10 further comprises a second portion 20 replaceably suspended from the first portion 18 for receiving the shower head 14 and for filling with a mild acid 22, with the shower head 14 submerged therein, so as to allow the mild acid 22 to dissolve the calcium deposits in the shower head 14 soaking in the mild acid 22 in the second portion 20, without having to remove the shower head 14 from the shower arm 16.

The mild acid 22 is vinegar.

Figure 3:
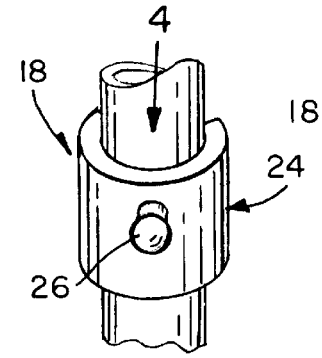
FIG. 3 is an enlarged diagrammatic perspective view of the area generally enclosed by the dotted curve identified by arrow 3 in FIGS. 1 and 2 of the collar of the present invention.
Figure 4:
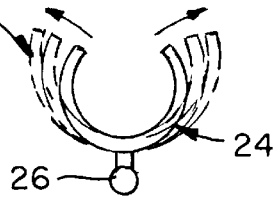
FIG. 4 is a diagrammatic top plan view taken generally in the direction of arrow 4 in FIG. 3.

The specific configuration of the first portion 18 can best be seen in FIGS. 3 and 4, and as such, will be discussed with reference thereto.

The first portion 18 comprises a collar 24 that is open-ended and resilient for replaceably snapping around the shower arm 16, adjacent the shower head 14, without having to remove the shower head 14 from the shower arm 16.

The first portion 18 further comprises a hook 26 that extends radially outwardly from the collar 24 of the first portion 18.

The first portion 18 is made from poly-vinyl-chloride possessing an inherent amount of resiliency.

Figure 5:
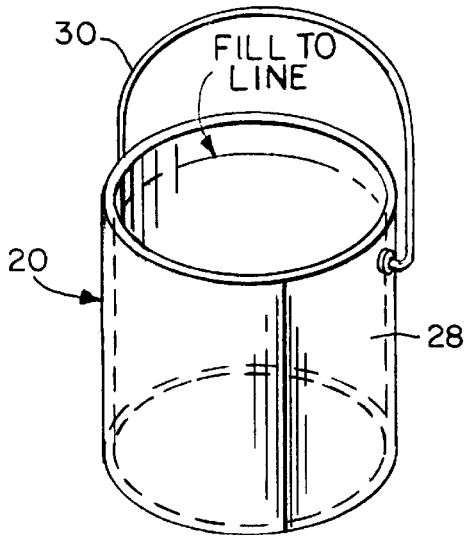
FIG. 5 is a diagrammatic perspective view of the area generally enclosed by the dotted curve identified by arrow 5 in FIGS. 1 and 2 of the cup of the present invention.

The specific configuration of the second portion 20 can best be seen in FIG. 5, and as such, will be discussed with reference thereto.

The second portion 20 comprises a cup 28 that is replaceably suspended from the hook 26 of the first portion 18 for receiving the shower head 14 and for filling with the mild acid 22, with the shower head 14 submerged therein, so as to allow the mild acid 22 to dissolve the calcium deposits 22 in the shower head 14 soaking in the mild acid 22 in the second portion 20, without having to remove the shower head 14 from the shower arm 16.

The cup 28 of the second portion 20 is made from a material that is non-reactive with the mild acid 22.

The material of the cup 28 of the second portion 20 is plastic.

The second portion 20 further comprises a bale handle that is pivotally mounted to the cup 28 of the second portion 20 and replaceably and suspendingly engages the hook 26 of the first portion 18, which holds the cup 28 of the second portion 20 in place.

It will be understood that each of the elements described above, or two or more together, may also find a useful application in other types of constructions differing from the types described above.

While the invention has been illustrated and described as embodied in a kit for removing calcium deposits from a shower head extending from a shower arm without removing the shower head from the shower arm, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A kit for removing calcium deposits in a shower head extending from a shower arm without removing the shower head from the shower arm, said kit comprising:

a) a first portion for replaceably attaching to the shower arm, adjacent the shower head; and b) a second portion replaceably suspended from said first portion for receiving the shower head and for filling with a mild acid, with the shower head submerged therein, so as to allow the mild acid to dissolve the calcium deposits in the shower head soaking in the mild acid in said second portion, without having to remove the shower head from the shower arm.

2. The kit as defined in claim 1, wherein said first portion is made from poly-vinyl-chloride possessing an inherent amount of resiliency.

3. The kit as defined in claim 1, wherein the mild acid is vinegar.

4. The kit as defined in claim 1, wherein said first portion comprises a collar that is open-ended and resilient for replaceably snapping around the shower arm, adjacent the shower head, without having to remove the shower head from the shower arm.

5. The kit as defined in claim 4, wherein said first portion further comprises a hook that extends radially outwardly from said collar of said first portion.

6. The kit as defined in claim 5, wherein said second portion comprises a cup that is replaceably suspended from said hook of said first portion for receiving the shower head and for filling with the mild acid, with the shower head submerged therein, so as to allow the mild acid to dissolve the calcium deposits in the shower head soaking in the mild acid in said second portion, without having to remove the shower head from the shower arm.

7. The kit as defined in claim 6, wherein said cup of said second portion is made from a material that is non-reactive with the mild acid.

8. The kit as defined in claim 7, wherein said material of said cup of said second portion is plastic.

* * * * *